United States Patent [19]

Takabatake et al.

[11] Patent Number: 4,980,954

[45] Date of Patent: Jan. 1, 1991

[54] SLIDER FOR SLIDE FASTENERS

[75] Inventors: Hideo Takabatake, Namerikawa; Tomonari Yoshida, Kurobe, both of Japan

[73] Assignee: Yoshida Kogyo K.K., Tokyo, Japan

[21] Appl. No.: 424,671

[22] Filed: Oct. 20, 1989

[30] Foreign Application Priority Data

Oct. 22, 1988 [JP] Japan ..... 63-137914[U]

[51] Int. Cl.[5] ..... A44B 19/30

[52] U.S. Cl. ..... 24/421; 24/419; 24/429

[58] Field of Search ..... 24/421, 419, 420, 422, 24/429, 418, 436

[56] References Cited

U.S. PATENT DOCUMENTS

| | | | |
|---|---|---|---|
| 2,629,912 | 3/1953 | Ulrich et al. . | |
| 2,657,445 | 11/1953 | Weber | 24/421 |
| 2,683,911 | 7/1954 | Backer | 24/421 |
| 3,099,059 | 7/1963 | Huelster | 24/421 |
| 3,267,544 | 8/1966 | Davies . | |
| 3,427,692 | 2/1969 | Rowlands . | |
| 3,793,684 | 2/1974 | Moertel | 24/421 |
| 4,644,613 | 2/1987 | Kedzierski . | |

FOREIGN PATENT DOCUMENTS

| | | | |
|---|---|---|---|
| 0059370 | 9/1982 | European Pat. Off. . | |
| 2238584 | 2/1973 | Fed. Rep. of Germany . | |
| 2298974 | 8/1976 | France . | |
| 0275146 | 8/1951 | Switzerland | 24/421 |
| 1497104 | 1/1978 | United Kingdom . | |

*Primary Examiner*—Victor N. Sakran

*Attorney, Agent, or Firm*—Hill, Van Santen, Steadman & Simpson

[57] ABSTRACT

A slider for slide fasteners comprises a slider body, a pull tab for manipulating a slider and a cap-like yoke mounted on the slider body to pivotally join the pull tab to the slider body. The cap-like yoke inlcudes a pair of opposite side walls each having a pair of opposite front and rear legs having the respective engaging means. Teh slider body has a pair of front and rear studs on its upper surface at the front end and the rear end, respectively, the front and the rear studs including the respective pairs of opposite side walls having on their respective inner surface engaging projections engageable with the engaging means for mounting the cap-like yoke on the slider body, so that the pull tab is pivotally joined with the slider body.

7 Claims, 5 Drawing Sheets

SLIDER FOR SLIDE FASTENERS

BACKGROUND OF THE INVENTION

1. Field of the Invention:

The present invention relates to a slider for opening and closing a slide fastener to be mainly used for clothes, shoes, baggages and the like articles and particularly to a construction for pivotally joining a pull tab with a slider body of the slider of the kind described above.

2. Description of the Prior Art:

U.S. Pat. No. 2,657,445 issued November 3, 1953 discloses a conventional slider of the type above described. As shown in FIG. 8 of the drawings appended hereto, such a slider comprises a slider body having a pair of front and rear studs A, B protuberantly provided at the front and rear ends, respectively, on the upper surface thereof, a pull tab C for manipulating the slider, a cap-like yoke D having a pair of side walls having the respective cut-outs therein, one formed in each of the opposite side walls thereof, and mounted on the slider body with the pivotal portion of the pull tab C pivotally received in the cut-outs. The front and rear studs A, B have in the outer surfaces of their respective opposite sides walls the respective pairs of engaging recesses a, a; b, b. The cap-like yoke D includes a pair of side walls having engaging tongue E, E; F, F at their respective front and rear ends. The cap-like yoke D further includes a flat spring portion G extending downwardly from the front end thereof and supported on the slider body so as to normally urge the cap-like yoke D into locking disposition where a locking prong provided at the rear end of the cap-like yoke D comes into locking engagement with fastener elements to lock the slider. The engaging tongues E, E; F, F of the cap-like yoke D are brought into engagement with the engaging recesses a, a; b, b in the front and rear studs A, B; with the outer surfaces of the side walls of the cap-like yoke D held flush with the outer surfaces of the side walls of the studs A, B; so that the pull tab C is pivotally joined with the slider body by means of the cap-like yoke D.

Such a conventional slider, however, has drawbacks in that, since the cap-like yoke having the pivotal portion of the pull tab received in the cut-outs thereof is snapped into engagement with the studs on the slider body with the outer surface of the cap-like yoke held flush with the outer surfaces of the studs, the cap-like yoke is liable to get easily detached from the slider body, whereby the proper function of the slider would be impaired and the cap-like yoke and the pull tab thus detached would be prone to be lost.

Furthermore, if such a conventional slider were of the automatically locking type, as disclosed in U.S. Pat. No. 2,657,445, assembling operation of the slider body, the pull tab and the cap-like yoke would be very difficult; since, for the assemblage, the rear engaging tongues of the cap-like yoke are first pressed from the front into engagement with the engaging recesses in the rear stud, and thereafter, the front engaging tongues of the cap-like yoke are depressed into snapping engagement with the engaging recesses of the front stud with the flat spring portion G inserted into a hole formed in the front end of the slider body.

Still furthermore, since the locking prong is provided as an extension extending contiguously downwardly from one of the side walls of the cap-like yoke which side wall is flush with the outer surfaces of the studs, the locking prong falls so far away from the coupling points where adjacent coupling heads of mating element rows are coupled so that it fails to accomplish sufficient locking effect. Even if the locking prong could be bent inwardly of the cap-like yoke or towards the coupling points so as to obtain sufficient locking effect, this would disadvantageously entail increased steps for assemblage and would be much more liable to lead to ununiformity in the form of resultant sliders.

SUMMARY OF THE INVENTION

With the above-mentioned drawbacks in view, it is an object of the present invention to provide a slider for slide fasteners wherein a cap-like yoke and hence a pull tab would be prevented against detachment from a slider body even if severe external stresses were exerted on any of those parts and which is easy to assemble.

According to the present invention, there is provided a slider for slide fasteners comprising a slider body, a pull tab for manipulating a slider and a cap-like yoke mounted on the slider body to pivotally join the pull tab to the slider body, the cap-like yoke including an upper face and a pair of opposite side walls extending downwardly from the opposite sides thereof, each of the side walls having a pair of opposite front and rear legs having the respective engaging means, the slider body having a pair of front and rear studs on its upper surface at the front end and the rear end, respectively, the front and the rear studs including the respective pairs of opposite side walls having on their respective inner surfaces engaging projections engageable with the engaging means for mounting the cap-like yoke on the slider body, so that the pull tab is pivotally joined with the slider body.

Many other advantages, features and additional objects of the present invention will become manifest to these versed in the art upon making reference to the detailed description and the accompanying drawings in which preferred embodiments incorporating the principles of the present invention are shown by way of illustrative example.

BRIEF DESCRIPTION OF THE DRAWINGS

FIG 3 (*b*) is a cross-sectional view showing how a locking prong is brought into locking engagement with fastener elements;

FIG. 7 (*b*) is a cross-sectional view of important part of a slider according to the third modified embodiment.

DETAILED DESCRIPTION

The principles of the present invention can be applied to both types of sliders; the type having a locking mechanism and the type not having a locking mechanism, albeit the following description will be made in reference to an automatically locking slider (hereinafter referred to as "slider").

Figure 1:
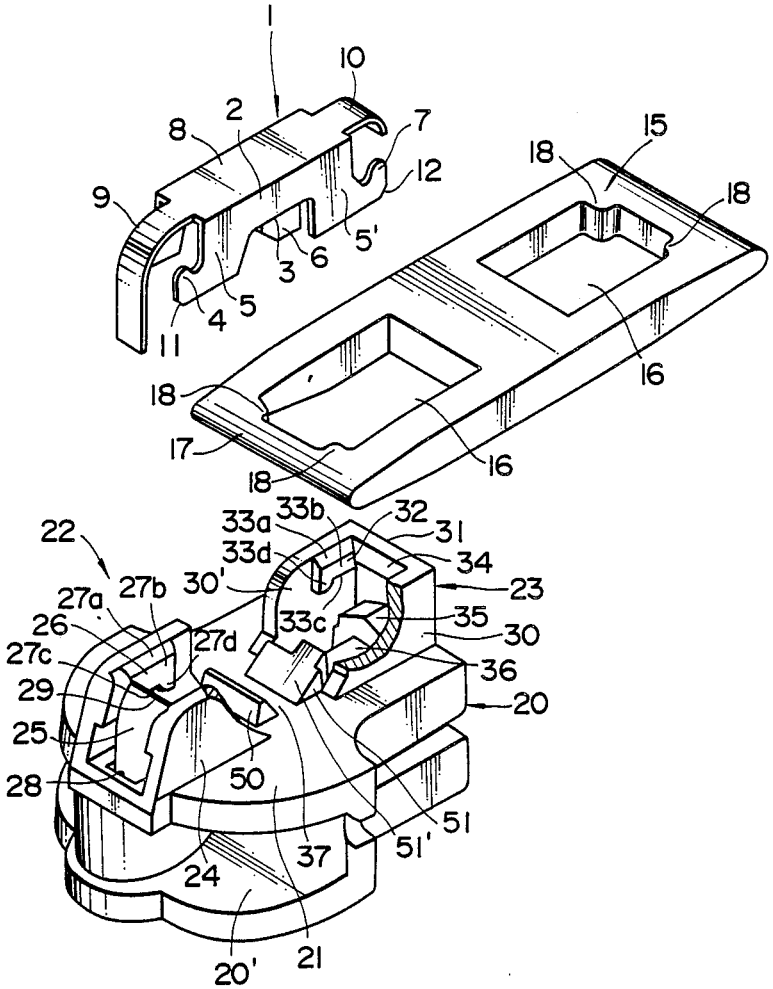
FIG. 1 is a perspective and exploded view, on enlarged scale, of a slider for slide fasteners according to the present invention.
Figure 2:
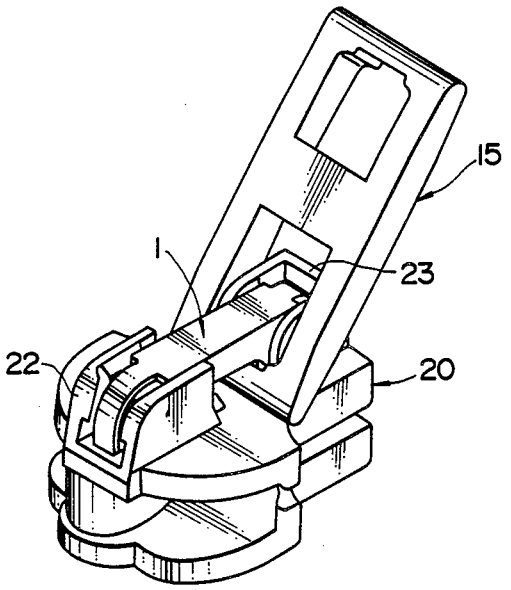
FIG. 2 is a perspective view of the slider of FIG. 1 in assembled disposition.

As better shown in FIG. 1, the slider broadly comprises three separate parts; that is, a cap-like yoke 1, a pull tab 15 and a slider body 20.

The cap-like yoke 1 is of an elongated and rectangular box-like shape which is open downwardly. The cap-like yoke 1 generally comprises a rectangular upper face 8, a pair of opposite side walls 2, 2 provided on and extending downwardly from the opposite sides thereof, a flat spring portion 9 extending arcuately downwardly from the front end thereof and a curved tail portion 10 also extending arcuately downwardly from the rear end thereof, the flat spring portion 9 being longer than the tail portion 10, thus extending further downwardly than the latter. Each of the side walls 2, 2 is provided at the middle of the lower edge thereof with a cut-out 3 for receiving therein a pivotal portion 17 of the pull tab 15, as described hereinafter, thereby forming front and rear legs 5, 5' on the opposite sides of the cut-out 3. Each of the front legs 5, 5 has its front side hooked to thus provide a front engaging means 4, and, similarly, each of the rear legs 5', 5', has its rear side hooked to thus provide a rear engaging means 7. As better shown in FIG. 4, either one of the rear legs 5', 5' has its lower end extended beyond the lower edge of the relevant side wall to thus provide a locking prong 6. Instead of either one of the rear legs 5', 5', both rear legs 5', 5' may be provided at their lower ends with locking prongs 6, 6.

As better shown in FIG. 1, the pull tab 15 is in the shape of a rectangular plate and includes a pair of rectangular apertures 16, 16 arranged in side-by-side relation to each other. That edge of the rectangular aperture 16 which is also a proximal end of the pull tab 15 forms a pivotal portion 17 for insertion through the cut-outs 3, 3 of the cap-like yoke 1, as described hereinabove. Step portions 18, 18; 18, 18 are provided on those corners of the apertures 16, 16 which also fall on the corners of the rectangular pull tab 15 and are adapted to enable the pivotal portion 17 of the pull tab 15 to be stably received in the cut-outs 3, 3 against lateral jolting, during the manipulation of the pull tab 15.

Figure 4:
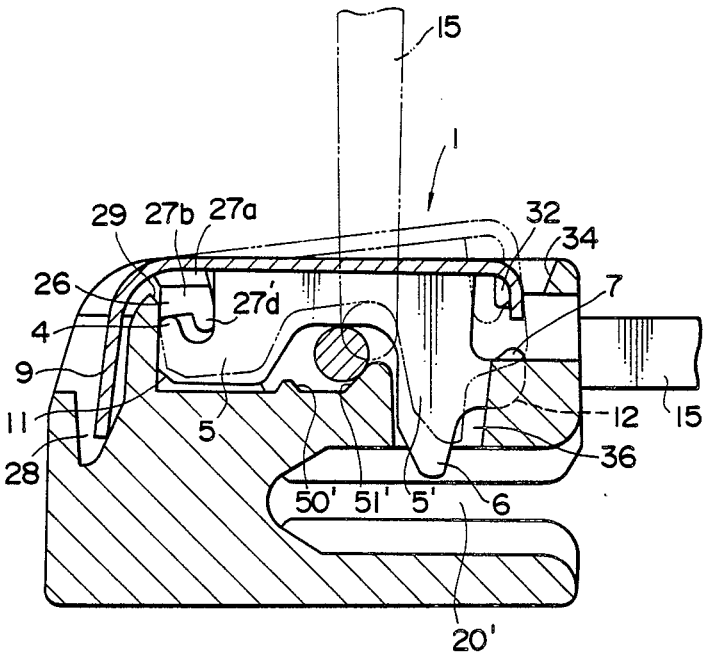
FIG. 4 is an enlarged longitudinal cross-sectional view of the slider.

As shown in FIGS. 1 and 4, the slider body 20 has a Y-shaped channel 20' formed longitudinally therethrough for allowing a pair of fastener element rows run therethrough to open and close a slide fastener. As seen in FIG. 1, the slider body 20 has on its upper surface 21 at its front and rear ends a pair of front and rear studs 22, 23, respectively. The front and rear studs 22, 23 are substantially of a U-shape and an inverted U-shape, respectively, as viewed from the above, and are disposed in such a relation as to have their open ends directed to each other. The front stud 22 includes a pair of opposed side walls 24, 24 and a central wall 25 joining the side walls 24, 24 at their front ends, to thus provide the U-shape. Each of the side walls 24, 24 has an engaging projection 26 protruded on its inner surface for engagement with the front engaging means 4 of the cap-like yoke 1. As better shown in FIG. 1, the front engaging projection 26 includes a bevelled guide portion 27*a* slanting inwardly downwardly from the upper edge of the side wall 24, an upright portion 27*b* extending perpendicularly downwardly from the lower edge of the bevelled guide portion 27*a* and a stepped portion 27*c* in which the upright portion 27*b* terminates. As better shown in FIG. 4, the front engaging projection 26 further has at its rear end an engaging tongue 27*d* projecting downwardly for firm engagement with the front hooked engaging means 4 of the cap-like yoke 1 so as to prevent the latter from getting detached even under stresses exerted during pulling-up of the pull tab. The central wall 25 has its front or outer surface so moderately curved as to prevent the flat spring portion 9 from being deformed during assemblage or reciprocal operation of the slider. Immediately forwardly of the lower end of the central wall 25 in the slider body 20 is formed a hole 28 to retentively receive therein the end portion of the flat spring portion 9. The upper end of the central wall 25 is slanted rearwardly downwardly to thereby provide a front slant guide portion 29 so as to guide the front end of the front engaging means 4 therealong during assemblage of the cap-like yoke 1 on the slider body 20. The assemblage may be much facilitated by providing the front engaging means 4 at it front corner with a guiding chamfer 11.

Figure 3A:
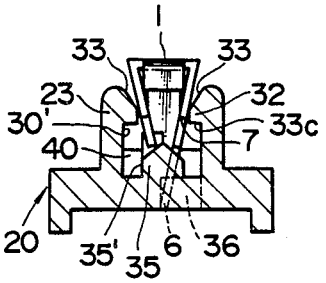
FIG. 3 (*a*) is a cross-sectional view showing the manner how a cap-like yoke is mounted on a slider body.
Figure 3B:
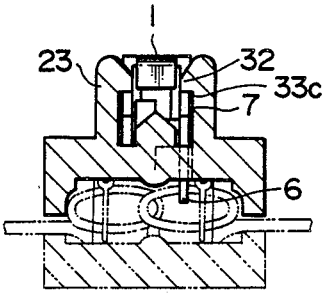

The rear stud 23 includes a pair of opposed side walls 30, 30 and a central or rear wall 31 joining the side walls 30, 30 at their rear ends, to thus provide the inverted U-shape. Each of the side walls 30, 30 of the rear stud 23 has, likewise to those of the front stud 22, an engaging projection 32 protruded on its inner surface for engagement with the rear engaging means 7 of the cap-like yoke 1. As better shown in FIG. 1, the engaging projection 32 includes a bevelled guide portion 33*a* slanting inwardly downwardly from the upper edge of the side wall 30, an upright portion 33*b* extending perpendicularly downward from the lower edge of the bevelled guide portion 33*a* and a stepped portion 33*c* in which the upright portion 33*b* terminates. The rear engaging projection 32 further has at its front end an engaging tongue 33*d* projecting downwardly for engagement with the rear hooked engaging means 7 of the cap-like yoke 1. As better shown in FIG. 4, the upper end of the rear wall 31 is slanted forwardly downwardly to thus provide a rear slant guide portion 34 for guiding the rear end of the rear engaging means 7 of the cap-like yoke 1 therealong during assemblage of the cap-like yoke 1 onto the slider body 20. This assemblage may be further facilitated by providing the rear engaging means 7 at it front corner with a guiding chamfer 12. As shown in FIGS. 1 and 3(*a*), provided on the inner surface of the rear wall 31 of the rear stud 23 is an inner block 35, which has its opposed side surfaces 35', 35' defining a pair of opposed slits 40, 40 with the respective confronting inner surfaces 30', 30' of the side walls 30, 30. The upper portion of the inner block 35 is of a triangle having its apex directed upwardly. As better shown in FIG. 3(*b*), an opening 36 is formed in the slider body forwardly of the lower end of the inner block 35 and communicates with the Y-shaped channel 20' for insertion of the locking prong 6 of the cap-like yoke 1 therethrough into the Y-shaped channel 20' as described closely hereinafter.

On the upper surface 21 of the slider body 20 between the front and rear studs 22, 23 are provided a pair of opposed front and rear triangular prisms 50, 51, with their respective slant surfaces 50' 51' opposed each other.

To assemble the pull tab 15 onto the slider body 20 of the slider according to the invention, the cap-like yoke 1 having the pivotal portion 17 of the pull tab 15 already received in their cut-outs 3, 3 are forced into between the front and rear studs 22, 23, with the side walls 2, 2, the front engaging means 4 and the rear engaging means 7 compressed by the bevelled guide portions 27*a*, 33*a*, the front slant guide portion 29 and the rear slant guide portion 34, respectively against their own resiliency, as shown in FIG. 3(*a*), until the front and rear engaging means 4, 7 have passed beyond the stepped portions 27*c*, 33*c*, respectively, whereupon the side walls 2, 2 are restored into its original posture under their own resiliency to thus bring the front and the rear engaging means 4, 7 into snapping engagement with the engaging tongues 27*d*, 33*d* of the front and the rear engaging projections 26, 32, respectively. At the same time, the flat spring portion 9 is inserted into the hole 28 in the slider body 20. The rear legs 5', 5' of the cap-like yoke 1 is received in the slit 40, 40, so that the rear legs 5', 5' are protected jointly by the opposed outer surfaces 35', 35' of the inner block 35 and the inner surfaces 30' 30' of the opposed side walls 30, 30 against being distorted or otherwise deformed under severe stresses exerted by the pull tab 15 during the manipulation of the slider. As better shown in FIG. 3(*b*), the cap-like yoke 1 is normally urged by the flat spring portion 9 in such a direction that the locking prong 6 on the rear leg 5' is inserted through the opening 36 into the Y-shaped channel 20' to thus come into locking engagement with coupling elements. The edges of the cut-outs 3, 3 of the cap-like yoke 1, the respective confronting slant surfaces 50', 51' of the triangular prisms 50, 51 and the upper surface left between the triangular prisms 50, 51 jointly form a bearing in which the pivotal portion 17 of the pull tab 15 is pivotally mounted. As shown in dash-and-dot lines in FIG. 4, the rear engaging projections 32, 32 of the rear stud 23 are engageable with the rear engaging means 7, 7 of the cap-like yoke 1 to thus limit the upward movement of the cap-like yoke 1 caused by a pull on the pull tab 15 so that the cap-like yoke 1 and hence the pull tab 15 is well prevented against detachment from the slider body 20.

To operate the slider according to the present invention, the pull tab 15 is pulled up against the resiliency of the flat spring portion 9, thereby raising the rear part of the cap-like yoke 1 and hence the locking prong 6 through the opening 36 out of the Y-shaped channel 20', so that the slider comes out of locking engagement with coupling elements. Subsequent horizontal pull of the pull tab 15 causes the slider reciprocate along the fastener element rows. After the reciprocation of the slider, a pull tab 15 is released, thus allowing the cap-like yoke 1 come into the original locking disposition under the resiliency of the flat spring portion 9.

Figure 5:
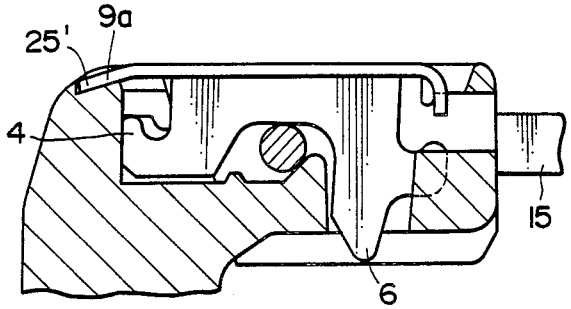
FIG. 5 is a fragmentary longitudinal cross-sectional view of a slider according to the first modified embodiment.

FIG. 5 shows another embodiment in which, instead of an elongated flat spring portion 9 extending arcuately downwardly in the first embodiment, the cap-like yoke 1 is provided at the front end thereof with a short flat spring member 9*a* extending substantially straight from the upper surface 21 of the cap-like yoke 1. The short flat spring member 9*a* is inserted into a hole 25' formed in the central wall 25 of the front stud 22.

Figure 6:
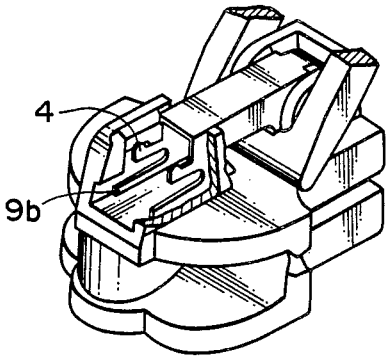
FIG. 6 is a perspective view of a slider according to the second modified embodiment.

FIG. 6 is still another embodiment in which a pair of pin-like spring portions 9*b* are provided as extensions of the lower edges of the front legs 5, 5 and disposed below and in spaced parallel relation to the pair of front engaging means 4, 4. When the cap-like yoke 1 is assembled onto the slider body 20, the pin-like spring portions 9*b* rest flat against the upper surface of the slider body 20.

Figure 7A:
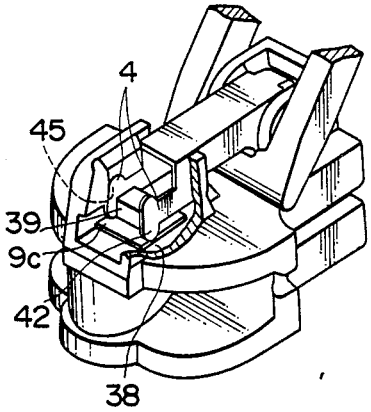
FIG. 7 (*a*) is a perspective view, partly cut-away, of a slider according to the third modified embodiment.
Figure 7B:
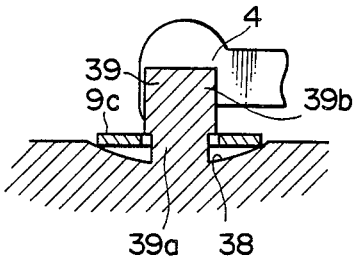
Figure 8:
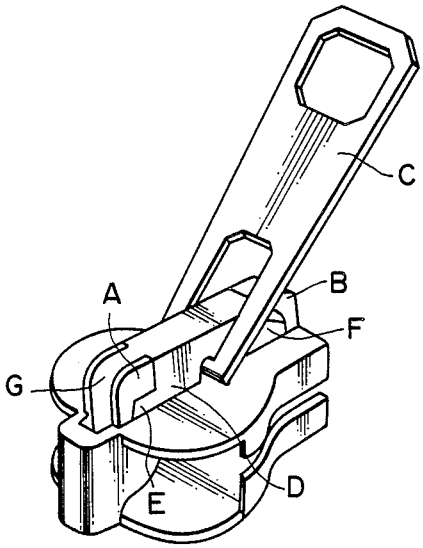
FIG. 8 PRIOR ART
FIG. 8 is a perspective view of a prior art slider.

FIGS. 7(*a*) and 7(*b*) show yet another embodiment in which, instead of the central wall 25 in the first embodiment, a space-filling block 39 is provided on the upper surface of the slider body 20 between the side walls 24, 24 of the front stud 22. As better shown in FIG. 7(*b*), the space-filling block 39 comprises a neck portion 39*a* provided upright on the upper surface of the slider body 20 and a substantially cubic head portion 39*b* provided integrally on the neck portion 39*a* and having a dimension larger than that of the neck portion 39*a*. A peripheral and cross-sectionally arcuate recess 38 is formed in the upper surface of the slider body 20 around the neck portion 39*a*. A separate plate spring 9*c* having a central rectangular aperture formed therein is inserted through the head portion 39*b* into the neck portion 39*a*, whereupon the plate spring 9*c* rests against the upper surface of the slider body 20 with the recess 38 left partly therebeneath. A pair of abutment lugs 42, 42 are provided one on the lower side of each front engaging means 4. The abutment lug 42 is adapted for abutting engagement with the plate spring 9*c* so that the cap-like yoke 1 is normally urged by the plate spring 9*c* in the direction tending to force the locking prong 6 thereof through the opening 36 into the Y-shaped channel 20' of the slider body 20. Furthermore, the head portion 39*b* defines at its opposite lateral surfaces with the inner or confronting surfaces of the side walls 24, 24 of the front stud 22 a pair of guide slits 45, 45 for receiving the front legs 5,5 of the cap-like yoke 1, thus to prevent the front legs 5, 5 and hence the front engaging means 4, 4 against objectionable deformation.

With the construction according to the present invention, the following effects are advantageously obtained.

Since the cap-like yoke having the pivotal portion of the pull tab received in the cut-outs thereof is firmly attached to the slider body by firm engagement of the engaging means of the cap-like yoke with the engaging projections formed on the inner surfaces of the front and rear studs of the slider body, the cap-like yoke is well prevented against accidental detachment from the slider body even under unexpected severe stresses, so that no malfunction of the slider will be caused, and the cap-like yoke and hence the pull tab will never be lost.

For assemblage, mere depression of the cap-like yoke into the front and rear studs with its side walls compressed could cause the engaging means of the cap-like yoke to come into engagement with the engaging projections formed on the inner surfaces of the side walls of the front and rear studs of the slider body at much ease.

Furthermore, since the side walls of the cap-like yoke are engaged with the inner surfaces of the side walls of the front and rear studs, the locking prong provided as an extension of the side wall of the cap-like yoke automatically falls close to the coupling points. Therefore, there is no need to provide a secondary or additional step of bending the locking prong close to the coupling point for increased locking effects.

Still furthermore, since the front and rear studs have at their respective upper ends slant guide portions slanting inwardly downwardly, this facilitate assemblage of the cap-like yoke onto the slider body very-much.

Obviously, many modifications and variations of the present invention are possible in the light of the above teachings. It is therefore to be understood that within the scope of the appended claims, the invention may be practiced otherwise than as specifically described.

What is claimed is:

1. A slider for slide fasteners comprising a slider body, a pull tab for manipulating a slider; a cap-like yoke mounted on the slider body to pivotally join the pull tab to the slider body, the cap-like yoke including an upper face and a pair of opposite side walls extending downwardly from the opposite sides thereof, each of the side walls having a pair of opposite front and rear legs having the respective engaging means, one of the rear legs having its lower end extended beyond the lower edge of the relevant side wall to provide a locking prong, the slider body having a pair of front and rear studs on its upper surface at the front end and the read end, respectively, the front and rear studs including the respective pairs of opposite side walls having on their respective inner surfaces engaging projections engageable with the engaging means for mounting the cap-like yoke on the slider body, so that the pull tab is pivotally joined with the slider body; and means secured to the front end of the slider body for normally urging the cap-like yoke in the direction tending to force the locking prong thereof through the opening into the Y-shaped channel of the slider body.

2. A slider for slide fasteners according to claim 1, the urging means comprising an elongated flat spring portion extending arcuately downwardly from the front end of the upper face of the cap-like yoke, the elongated flat spring portion being inserted into the hole formed immediately forwardly of the lower end of the central wall in the slider body.

3. A slider for slide fasteners according to claim 1, the urging means comprising a short flat spring member extending substantially straight from the front end of the upper surface of the cap-like yoke, the short flat spring member being inserted into a hole formed in the central wall of the front stud.

4. A slider for slide fasteners according to claim 1, the urging means comprising a pair of pin-like spring portions provided as extensions of the lower edges of the front legs and disposed below and in spaced parallel relation to the pair of front engaging means; the pin-like spring portions resting flat against the upper surface of the slider body.

5. A slider for slide fasteners according to claim 1, the urging means comprising a space-filling block provided on the upper surface of the slider body between the side walls of the front stud, the space-filling block including a neck portion provided upright on the upper surface of the slider body and a head portion provided integrally on the neck portion and having a dimension larger than that of the neck portion; part of the upper surface of the slider body having a peripheral and cross-sectionally arcuate recess defined around the neck portion; a separate plate spring having a central rectangular aperture formed therein and resiliently inserted through the head portion into the neck portion, the plate spring resting against the upper surface of the slider body with the recess left partly therebeneath; and a pair of abutment lugs provided one on the lower side of each engaging means for abutting engagement with the plate spring.

6. A slider for slide fasteners comprising a slider body, a pull tab for manipulating a slider and a cap-like yoke mounted on the slider body to pivotally join the pull tab to the slider body, the cap-like yoke including an upper face and a pair of opposite side walls extending downwardly from the opposite sides thereof, each of the side walls having a pair of opposite front and rear legs having the respective engaging means, the slider body having a pair of front and rear studs on its upper surface at the front end and the rear end, respectively, the front and rear studs including the respective pairs of opposite side walls having on their respective inner surfaces engaging projections engageable with the engaging means for mounting the cap-like yoke on the slider body, so that the pull tab is pivotally joined with the slider body, and each of the engaging projections including a bevelled guide portion slanting inwardly downwardly form the upper edge of a respective one of the side walls of the front and rear studs.

7. A slider for slide fasteners comprising a slider body, a pull tab for manipulating a slider and a cap-like yoke mounted on the slider body to pivotally join the pull tab to the slider body, the cap-like yoke including an upper face and a pair of opposite side walls extending downwardly from the opposite sides thereof, each of the side walls having a pair of opposite front and rear legs having the respective engaging means, the slider body having a pair of front and rear studs on its upper surface at the front end and the rear end, respectively, the front and rear studs including the respective pairs of opposite side walls having on their respective inner surfaces engaging projections engageable with the engaging means for mounting the cap-like yoke on the slider body, so that the pull tab is pivotally joined with the slider body, and the front stud further including a central wall joining the side walls at their front ends, the upper end of the central wall is slanted rearwardly downwardly to provide a slant guide portion.

* * * * *